United States Patent [19]

O'Neal

[11] 4,253,352

[45] Mar. 3, 1981

[54] TOOL FOR OPENING CANS

[76] Inventor: Gilbert L. O'Neal, 18455 Biscayne Dr., Miami, Fla. 33030

[21] Appl. No.: 36,411

[22] Filed: May 7, 1979

[51] Int. Cl.[3] ..... B67D 7/40

[52] U.S. Cl. ..... 81/3.46 R

[58] Field of Search ..... 81/3.46 R, 3.46 A, 3.34; 7/151; 254/131

[56] References Cited

U.S. PATENT DOCUMENTS 4,120,216 10/1978 Goldberg ..... 81/3.46 A

FOREIGN PATENT DOCUMENTS 1067570 1/1954 France ..... 7/138

*Primary Examiner*—Othell M. Simpson
*Assistant Examiner*—Roscoe V. Parker
*Attorney, Agent, or Firm*—John Cyril Malloy

[57] ABSTRACT

A tool for opening cans in the form of a sleeve sized to receive a lever fixed to a can and operable to bend a weakened portion of a can top into the can in a hinged swinging action, the tool having a mouth and longitudinally extending slit at one end sized to receive the lever and being adapted for use in applying additional downward pressure supplementing that of the lever of the can to open a can.

3 Claims, 5 Drawing Figures

TOOL FOR OPENING CANS

This invention is of a tool previously described in documents submitted pursuant to the disclosure document of the U.S. Patent and Trademark Office and recorded with the Commissioner under Ser. No. 075,433 on or about Oct. 31, 1978 to which reference is made together with the request that the same be included in the file of this case.

FIELD OF THE INVENTION

This invention relates to a tool for opening cans.

BACKGROUND OF THE INVENTION

Numerous cans are utilized for containing products, such as beverages, which cans are of the type which are adapted to be opened by manipulating a lever on the top of the can. Generally speaking, such cans have a top surface with a central zone from which a top portion extends radially which is bounded by a weakened line of juncture between the radially extending zone and the can top proper and which is adapted to be forceably broken in response to downward pressure and to be hingedly swung about a hinge line at the central zone and swung into the interior of the can upon manipulation of the lever. The lever of such cans includes a portion which extends over the radially extending portion and another end which extends substantially to the outer periphery of the can with the lever being spaced slightly above the top surface of the can and being connected to the can at the center thereof. Upon lifting of the terminal end of the lever it pivots about the central connection point with a portion extending over the radially extending can top surface bounded by the weakened border or periphery being adapted to be forced downwardly when the lever is raised hingedly folding it into the interior of the can.

Persons opening such cans often find it difficult to obtain a bite or grip about the lever to conveniently raise it, without endangering fingernails or incurring the risk of cuts on the metal. This is a problem which is somewhat aggravated by the fact that one's hands are often wet when doing this tending to increase the likelihood of cuts.

This invention is of a tool which is in sleeve form for use in jacketing the extending lever arm and for use in applying additional leverage in opening the can.

Objects of the Invention

It is an object of this invention to provide a tool for use in opening cans of the type described above which is composed of an elongate sleeve portion having a first end with a mouth and a slit extending from the mouth toward the other end of the tool and which mouth and slit are sized to jacket the lever of such cans so that the opposite or second end of the tool is adapted to be lifted to apply pressure to open the can without endangering or risking cuts or damage to one's fingernails.

Generally speaking, it is an object of this invention to provide an improved tool for use in opening cans of the type described above which tool is more particularly set forth hereinafter in three embodiments and which tool, irrespective of which embodiment is employed, is simple in construction, of rigid material, and well adapted for the purposes which are set forth more fully hereinafter.

In accordance with these and other objects which will become apparent hereinafter, the instant invention will now be described with reference to the accompanying drawings in which:

DESCRIPTION OF THE PREFERRED EMBODIMENT

Figure 1:
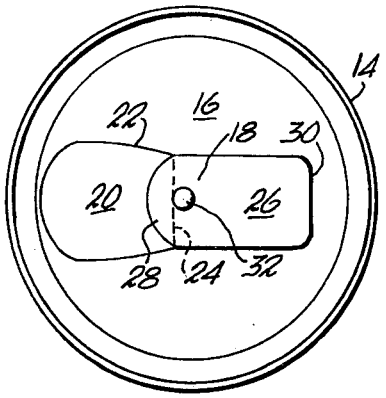
FIG. 1 is a top plan view of a conventional beverage can shown schematically.

Referring to the drawings wherein like reference characters designate like or corresponding parts throughout the several views, and more particularly to FIG. 1, there is shown a tool which is generally designated by the numeral 12. It is for use in opening cans, such as that indicated by the numeral 14 which conventionally has a top 16 with a central zone 18 from which there extends radially a portion 20 with a weakened peripheral boundary 22 and which is not weakened along a hinge line 24 adjacent the center of the top 16. Above the level or surface of the can top, there is provided a lever 26 which includes a portion 28 which extends over the portion 20 in closely adjacent relation and, in the opposite direction to a terminal end 30 spaced from a central attachment means 32 connecting it to the top of the can, with this lever 26 being in a plane generally parallel to the top of the can but slightly spaced above it a predetermined distance.

Figure 2:
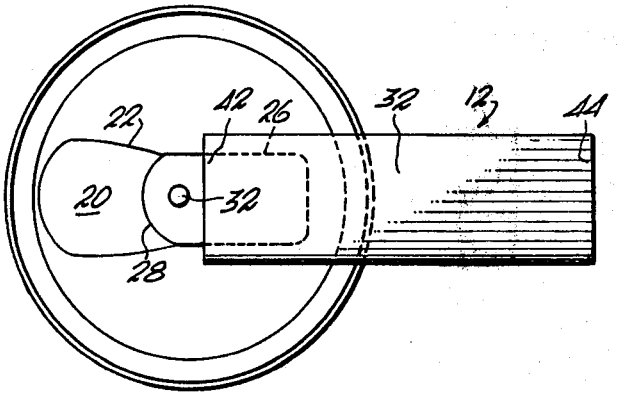
FIG. 2 is a view similar to FIG. 1 and illustrating the use of the instant tool.
Figure 3:
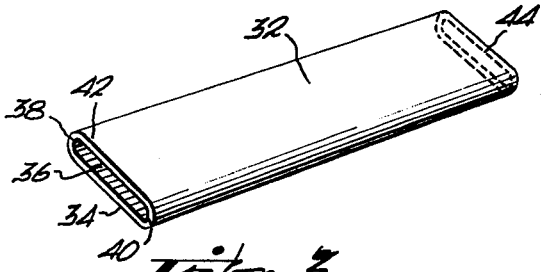
FIG. 3 is a view of the tool shown in FIG. 1.

As seen in FIG. 2, the tool 12 comprises a sleeve having an upper surface 32 and, as seen in FIG. 3, a lower surface 34 which are in generally parallel relation, that is, each are spaced apart a distance sufficient to provide a mouth 36 at one end of a size between the side edges 38 and 40 of the sleeve sufficient such that within the hollow interior of the sleeve, the terminal end zone 30 is adapted to be inserted in the manner shown in FIG. 2. The tool has a first end 42 and a second end 44, the ends being spaced apart a distance at least twice as long as the extending portion of the lever of the can top from the central attachment 32 to the terminal end 30. In use, the lever is inserted by sliding the terminal end into the mouth while the lower surface of the sleeve 34 slides between the lever and the can top, it being of a sufficiently thin thickness so as to accomplish this insertion. Thereafter, an upwardly lifting force is applied to the end 44 to cause the lever portion 28 to apply a downward pressure to the can top portion bounded by the weakened boundary 22 to be forced downwardly and hingedly moved in a swinging action about the hinge line 24 into the can for opening it. Thereafter, the sleeve is simply removed for subsequent similar use.

Figure 4:
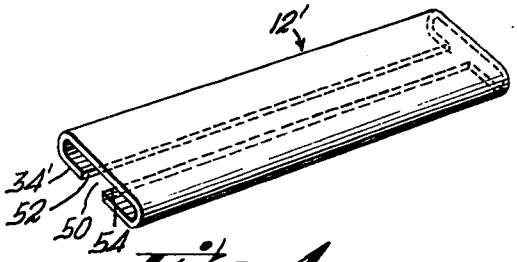
FIG. 4 is an alternative construction of the tool shown in FIG. 1.

Referring to the embodiment shown in FIG. 4, which is designated by the numeral 12', a somewhat similar tool is provided with the exception that the lower surface 34' is provided with a longitudinally extending slit 50 between the edges 52 and 54. The use of the tool is similar to that described above.

Figure 5:
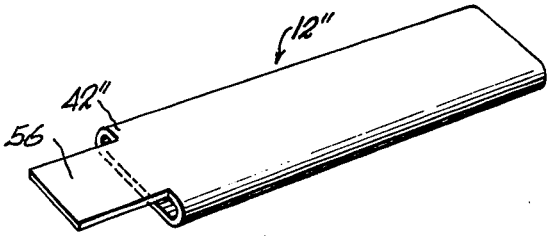
FIG. 5 is an alternative view of the tool shown in FIG. 1.

Referring to the embodiment shown in FIG. 5, a slightly different embodiment is shown. This tool, designated by the numeral 12'', includes, at the first end 42'' a longitudinally extending portion 56 of the upper surface which extends a distance less than that of the radial dimension of the weakened portion of the top of the can. The use of this tool is similar to that described above with the exception that the extending portion 56 will bear against the upper surface of the can within the weakened boundary 22 applying pressure to supplement that of the lever portion 28 which also engages the portion 20 of the top of the can bounded by the weakened zone 22.

It is thus seen that there is provided a simple and inexpensively constructed tool highly useful and efficient for purposes of opening cans of the type described so that fingernails are not broken or a person's fingers cut in a repetitive operation, often when one's hands are wet and the flesh is somewhat softened.

What is claimed is:

1. A tool for opening cans of the type having a top surface with a central zone and a generally radially extending zone bounded by a weakened connection with the top surface of the can and which radially extending zone is adapted to be forceably broken from the top surface in response to downward pressure and to be hingedly swung into the interior of the can along a bendable hinge line adjacent the central zone and wherein the can includes a lever with a portion extending over the radially extending zone and a portion extending to a terminal end and radially away from the radially extending zone toward but not to the can periphery with the lever extending in parallel closely spaced relation to the can top and with the lever being fixed between the terminal end and the extending portion so that when the terminal end is lifted, a downward force is applied to the extending radial zone of the can top to break it from the top and to bend it into the can, said tool comprising:

a generally sleeve shaped device having a first end and a second end and of a length at least twice that of the distance between the terminal end of the lever and the center of the can, said tool having an upper surface and a lower surface in closely adjacent spaced generally parallel relation and side walls interconnecting the upper and lower surfaces, said tool defining a mouth and having a longitudinally extending surface extending from the mouth at said first end toward said second end, said mouth being sized to receive the terminal end of the lever and the thickness of the lower surface being less than the distance between the lever and the can top, for use in applying additional leverage to open a can;

said upper surface including at said first end a longitudinally extending portion of a longitudinal length less than the longitudinally extending length of the radially extending zone of the top of the can and of a thickness less than the distance across the radially extending zone between the weakened areas of juncture of the radially extending can top zone with the can top.

2. The tool as set forth in claim 1 wherein said lower surface includes a longitudinally extending slit extending toward the second end defining generally parallel edges spaced from one another and extending from said first end toward said second end.

3. The device as set forth in claim 1 wherein the sleeve is tubular.

* * * * *